US008763529B2

(12) United States Patent
Buck et al.

(10) Patent No.: US 8,763,529 B2
(45) Date of Patent: Jul. 1, 2014

(54) METHOD OF COMPENSATING FOR VIBRATION-INDUCED CIRCUMFERENTIAL REGISTER ERRORS IN A SHEET-FED PRINTING PRESS AND SHEET-FED PRINTING PRESS CARRYING OUT THE METHOD

(75) Inventors: Bernhard Buck, Heidelberg (DE); Stefan Schreiber, Edingen-Neckarhausen (DE); Malte Seidler, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1278 days.

(21) Appl. No.: 11/923,707

(22) Filed: Oct. 25, 2007

(65) Prior Publication Data

US 2008/0098920 A1 May 1, 2008

(30) Foreign Application Priority Data

Oct. 25, 2006 (DE) ..... 10 2006 050 208

(51) Int. Cl.
*B41F 33/00* (2006.01)
*B41F 1/54* (2006.01)
*B41F 1/34* (2006.01)

(52) U.S. Cl.
USPC ..... 101/484; 101/483; 101/485

(58) Field of Classification Search
USPC ..... 101/481, 484–486, DIG. 36
See application file for complete search history.

(56) References Cited

U.S. PATENT DOCUMENTS

| | | | | |
|---|---|---|---|---|
| 4,563,735 | A * | 1/1986 | Hiroi et al. | 700/45 |
| 5,398,603 | A | 3/1995 | Hartmann et al. | |
| 6,156,158 | A * | 12/2000 | Kustermann | 162/198 |
| 6,401,620 | B1 | 6/2002 | Buck et al. | |
| 6,523,468 | B1 | 2/2003 | Loffler et al. | |
| 6,796,183 | B2 | 9/2004 | Noell | |
| 7,478,593 | B2 | 1/2009 | Hefftler et al. | |

(Continued)

FOREIGN PATENT DOCUMENTS

| | | | |
|---|---|---|---|
| DE | 4218604 | A1 | 12/1993 |
| DE | 19914627 | A1 | 10/2000 |

(Continued)

OTHER PUBLICATIONS

German Search Report, dated Mar. 27, 2007.

(Continued)

*Primary Examiner* — Ren Yan
*Assistant Examiner* — Marissa Ferguson Samreth
(74) *Attorney, Agent, or Firm* — Laurence A. Greenberg; Werner H. Stemer; Ralph E. Locher

(57) ABSTRACT

A method of compensating for vibration-induced circumferential-register errors in a sheet-fed printing press includes compensating for at least one vibration-induced deviation of an actual angular position of a cylinder from a nominal angular position by adjusting the circumferential register of at least one printing unit, in particular of the cylinder. For this purpose, the current vibration state of the sheet-fed printing press is determined, the effect of the determined vibrations of an integer order on a position of color excerpts on a sheet of printing material is calculated, and the compensating circumferential-register adjustment required in accordance with the result of the calculation is carried out. A sheet-fed printing press for carrying out the method, is also provided.

15 Claims, 2 Drawing Sheets

(56) References Cited

U.S. PATENT DOCUMENTS

Figure 1:
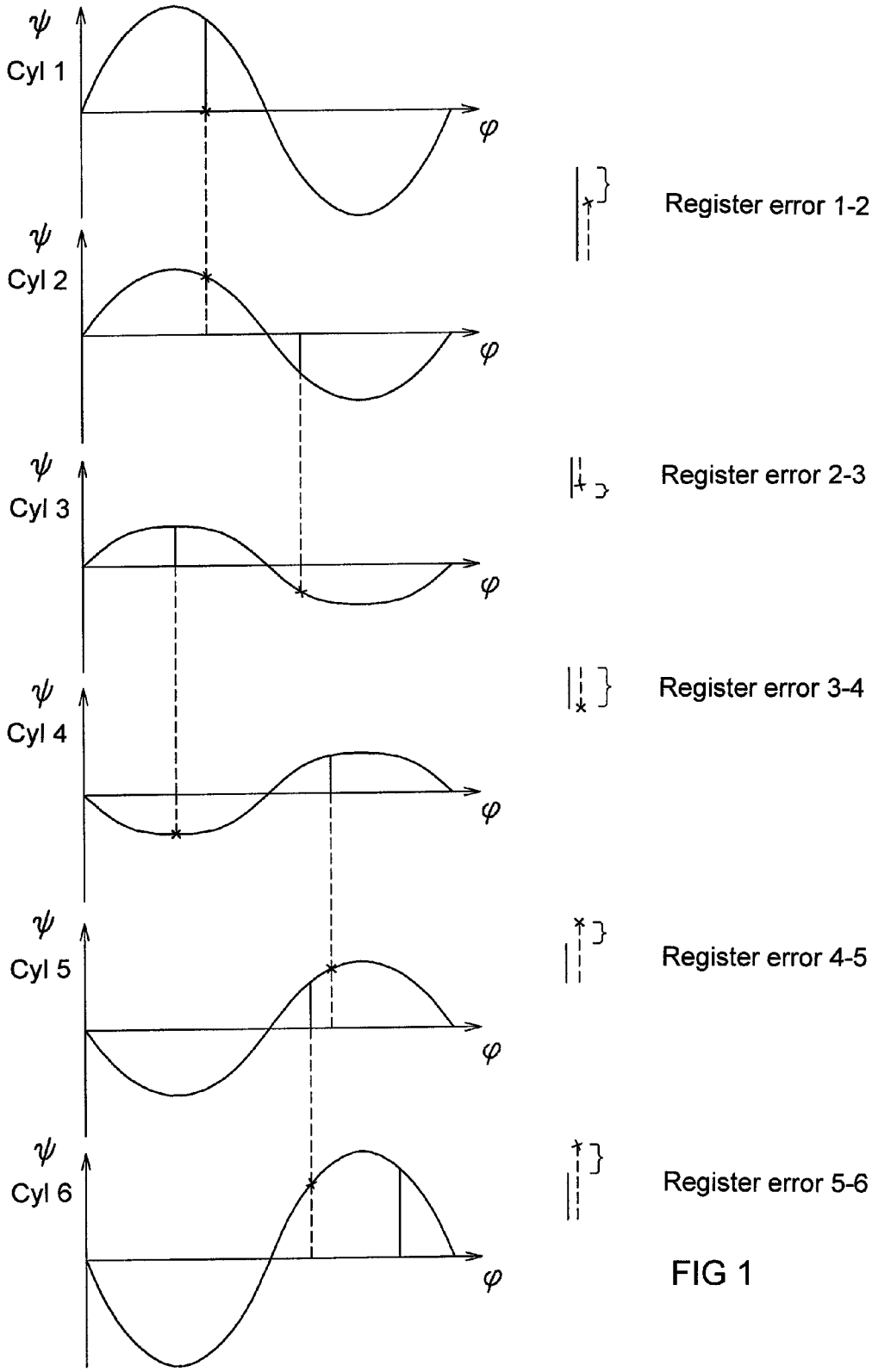

| | | | | |
|---|---|---|---|---|
| 2003/0230205 | A1* | 12/2003 | Mutschler et al. | 101/216 |
| 2006/0254442 | A1 | 11/2006 | Mutschler et al. | |
| 2007/0034101 | A1 | 2/2007 | Hefftler et al. | |

FOREIGN PATENT DOCUMENTS

| | | | |
|---|---|---|---|
| DE | 10149525 | A1 | 5/2002 |
| DE | 10217707 | A1 | 11/2003 |
| DE | 10309670 | A1 | 9/2004 |
| DE | 102004031508 | A1 | 2/2006 |
| DE | 102004048151 | A1 | 4/2006 |
| DE | 102004062110 | A1 | 7/2006 |
| EP | 0709184 | A1 | 5/1996 |
| EP | 1674258 | A1 | 6/2006 |
| JP | 6031905 | A | 2/1994 |
| JP | 2006175876 | A | 7/2006 |

OTHER PUBLICATIONS

European Search Report dated Sep. 16, 2009.

* cited by examiner

METHOD OF COMPENSATING FOR VIBRATION-INDUCED CIRCUMFERENTIAL REGISTER ERRORS IN A SHEET-FED PRINTING PRESS AND SHEET-FED PRINTING PRESS CARRYING OUT THE METHOD

CROSS-REFERENCE TO RELATED APPLICATION

This application claims the priority, under 35 U.S.C. §119, of German Patent Application DE 10 2006 050 208.6, filed Oct. 25, 2006; the prior application is herewith incorporated by reference in its entirety.

BACKGROUND OF THE INVENTION

Field of the Invention

The invention relates to a method of compensating for vibration-induced or related circumferential register errors in a sheet-fed printing press. At least one vibration-induced deviation of an actual angular position of a cylinder from a nominal angular position is compensated for by an adjustment of the circumferential register of at least one printing unit. In addition, the invention relates to a sheet-fed printing press including a number of printing units and a register control unit having actuators for changing angular positions of cylinders in individual printing units.

A critical aspect in the production of high-quality multicolor prints using a plurality of printing units in a sheet-fed printing press is that the individual color excerpts must be printed on top of each other onto a sheet of printing material in precise alignment, i.e. in register. For that purpose, conventional sheet-fed printing presses include a control unit for controlling or regulating register by changing the position of one or more cylinders in a printing unit in several degrees of freedom through the use of actuators, for example by the drive of the cylinder. In particular, the angular position of a plate cylinder or a sheet-guiding cylinder (or drum) may be modified so that the phasing of the cylinder (or drum) is changed (circumferential register). Register errors in the longitudinal direction of the sheet can be compensated for if a corresponding correction of the angular position in the opposite direction is made.

A plurality of operational parameters such as operating speed, accelerations and decelerations, temperature, position of the printing plates received on the plate cylinders and sheet transfer, have an influence on the amount of register deviation of two successive printing units. Yet even during stationary operation of a sheet-fed printing press, stationary register deviation occurs.

German Published, Non-Prosecuted Patent Application DE 10 2004 031 508 A1 describes, for example, that, compared to in-register printing with a defined set of values of operating parameters, the varying static loads that occur with different values of operational parameters, in particular with the varying torque flow from a drive depending on the operating parameters, cause a static register deviation. That register deviation can be corrected by modifying the circumferential register in the opposite direction, in particular by a corresponding modification of nominal values for angle of rotation of the cylinder to be brought into register. For that purpose, the expected register deviation is calculated in advance from drive and load torques that are present and elasticity of the drive train through the use of a torque flow model.

Moreover, it is known that vibrations in a sheet-fed printing press can be generated in dependence on values of operating parameters. German Published, Non-Prosecuted Patent Application DE 42 18 604 A1, corresponding to U.S. Pat. No. 5,398,603, for example, points out that register deviations in the longitudinal direction of the sheet may occur in the printed image as a consequence of those vibrations. In other words, vibration-induced dynamic register deviation may likewise be present. In accordance with German Published, Non-Prosecuted Patent Application DE 42 18 604 A1, corresponding to U.S. Pat. No. 5,398,603, the occurring register error is measured in the printing press directly through the use of a register measurement device or indirectly through the use of a sheet position detector, so that the circumferential register can be corrected in a corresponding way.

In general, particularly strong vibrations are created in a sheet-fed printing press when the frequency of a vibration-inciting disturbance torque corresponds to an eigenfrequency or resonant frequency of the sheet-fed printing press or of a part of the sheet-fed printing press. The frequencies of various disturbance torques frequently depend on individual operating parameters. Disturbance torques with relatively strong amplitudes, in particular, may have speed-dependent frequencies. A distinction is above all to be made between frequencies of an integer order, i.e. frequencies that are an integer multiple of the operating frequency of the sheet-fed printing press, and frequencies of a non-integer order, i.e. frequencies that are a non-integer multiple of the operating frequency of the sheet-fed printing press. A vibration of an integer order has a defined phasing relative to an operating cycle of the printing press.

In accordance with the process of register correction described in German Published, Non-Prosecuted Patent Application DE 42 18 604 A1, corresponding to U.S. Pat. No. 5,398,603, it is irrelevant whether the source of the disturbance that caused the register deviation is of a static or of a dynamic type because it is only the resultant error total that is measured and corrected.

BRIEF SUMMARY OF THE INVENTION

It is accordingly an object of the invention to provide a method of compensating for, reducing or avoiding vibration-induced dynamic circumferential register errors in a sheet-fed printing press and a sheet-fed printing press for carrying out the method, which overcome the hereinafore-mentioned disadvantages of the heretofore-known methods and devices of this general type in a targeted way.

With the foregoing and other objects in view there is provided, in accordance with the invention, a method of compensating for (or counteracting or correcting) vibration-related or vibration-induced errors in circumferential register of a sheet-fed printing press, in particular for multicolor printing, which comprises compensating for at least one vibration-induced deviation of an actual angular position of a cylinder from a nominal angular position, in particular of a sheet-guiding cylinder, by an adjustment of the circumferential register of at least one printing unit (of the sheet-fed printing press). For this purpose, the current vibration state of the sheet-fed printing press (during operation) is determined, the influence of the determined vibrations of an integer order, i.e. of those vibrations having a frequency which is an integer multiple of the operating frequency of the sheet-fed printing press, on the position of color excerpts on a sheet of printing material, in particular on the angular position of the at least one cylinder, is calculated, and the compensating adjustment of the circumferential register, in particular of the angular position of the cylinder as the required compensating circumferential register adjustment, is carried out as required in accordance with the calculated result.

In accordance with another feature of the invention, the vibrations may, in particular, be rotational vibrations. The adjustment of the circumferential register of at least one printing unit may be carried out by adjusting the circumferential register of a cylinder, in particular by adjusting the phasing or angular orientation of a cylinder. Alternatively, the cylinder to be adjusted may be part of a different printing unit of the sheet-fed printing press, i.e. of a printing unit that is different than the printing unit in question. The cylinder may, in particular, be a plate cylinder or a sheet-guiding cylinder. The cylinder may be a part of the printing unit having a circumferential register which is adjusted. The plate cylinder of the printing unit may be the cylinder carrying the circumferential register. The adjustment of the circumferential register of at least one printing unit may be carried out by adjusting a plate cylinder or by adjusting a cylinder located along the path of sheet travel through the printing press, in particular a sheet-guiding cylinder (preferred). The adjustment of the circumferential register of at least one printing unit may be done by adjusting the cylinder on which a deviation of the actual angular position from a nominal angular position has been determined (measured, quantified), or by adjusting a different cylinder. The deviation may be determined, measured, or quantified on a plate cylinder or a sheet-guiding cylinder.

A vibration-induced register error, i.e. a vibration-induced dynamic register deviation, can be corrected in an advantageous way. The invention makes use of the realization that for stationary operating conditions, vibrations of an integer order dynamically induce a stationary register error. Since the state of vibration of the sheet-fed printing press is known, the register deviation, which depends on operating parameters such as the machine speed or the vibration damping measures present in the machine, is determined by measuring, calculating on the basis of a model, or by calculating while taking into account measured values, so that the circumferential register can be pre-controlled to counteract the register deviation to prevent any register deviation from becoming visible on the printed image. The measurements and/or calculations may be carried out in advance or during operation of the sheet-fed printing press (online). The adjustment of the circumferential register is preferably carried out at a speed that is low enough to avoid ghosting.

The invention provides accurate pre-control or advance control of the circumferential register of the sheet-fed printing press in an advantageous way. This may reduce waste and the number of necessary adjustment interventions. The method steps that go beyond the conventional controls can be easily implemented without much effort.

The method according to the invention can be used to particular advantage in sheet-fed printing presses that include a large number of printing units, in particular four, five, six, eight, ten, or twelve printing units in horizontal in-line construction. In the graphic arts industry, printing presses of that type are referred to as long presses. The higher the number of printing units, the larger the vibration amplitudes may become, and thus direct counteracting of the vibrations or taking measures to avoid disadvantageous effects, i.e. in the present case the vibration-induced dynamic register deviation, becomes more and more important.

In accordance with a first embodiment of the method according to the invention, the current vibration state is determined by measuring with the aid of rotary vibration sensors or torque sensors on the sheet-fed printing press and by determining those vibrations among the measured vibrations having a frequency which is an integer multiple of the operating frequency of the sheet-fed printing press. This way to proceed is preferred inasmuch as vibrations currently occurring in the sheet-fed printing press are directly and individually quantified without falling back on theoretic models with the required simplifying assumptions or generalizations. The proportion of the vibrations of an integer order can, in particular, be determined by ascertaining the amplitude and phase of the vibrations of an integer order, for example by filtering the measured vibration total or the entire frequency spectrum or by orthogonal correlation.

In accordance with an alternative, second embodiment of the method according to the invention, the current vibration state is selected as a function of the current values of operating parameters from a plurality of vibration state values that have been calculated in dependence on the values of operating parameters and stored in a memory, parameterized by values of operating parameters of the sheet-fed printing press. The operating parameters may describe the state of operation of the sheet-fed printing press. Important examples of such operating parameters are the machine speed, the temperature, or the mode of operation of the sheet-fed printing press in terms of straight printing (i.e. printing on one side of the sheets only) or perfecting (i.e. printing on both sides of the sheets). Vibration models for sheet-fed printing presses based on which the occurring vibrations can be calculated as a function of the state of operation, are known to a person skilled in the art. The model used for a specific sheet-fed printing press must be suitable to describe the occurring vibrations with sufficient accuracy. The values of the vibration states may be stored in various suitable forms. A first option is to store the amplitudes and phasing of the dominant vibration orders for all cylinders as a function of the printing speed. A second option is to store the variation in time of the vibration orders in the memory.

In accordance with an alternative third embodiment of the method according to the invention, the current vibration state is selected as a function of the current values of operating parameters from a plurality of vibration state values that have been measured in dependence on the values of operating parameters and stored in a memory, parameterized by values of operating parameters of the sheet-fed printing press.

In accordance with an alternative fourth embodiment of the method according to the invention, the current vibration state is calculated from a vibration state that has been measured or calculated as a function of a set of values of operating parameters and stored in a memory, and as a function of the current values of operating parameters. In other words, the vibration state can be determined with the aid of a combination of a measurement during the printing operation and a model. Operating parameters that represent vibration-determining parameters but are not known to the control can be monitored during the printing operation (online) so that it is possible to factor them into the stored vibration state. An important application of this embodiment is present in view of the press temperature, having a relationship with the damping which is known.

In accordance with a further mode of the invention, the calculation of the effect of the determined vibrations of an integer order may be carried out in different ways for different embodiments. On one hand, the effect that the determined vibrations of an integer order have on the position of the color excerpts on a sheet of printing material, in particular the angular position of the at least one cylinder, may be calculated by the printing press, in particular during the printing operation (online), with the aid of a concurrent sheet tracking model. On the other hand, the relationship for describing the effect that the determined vibrations of an integer order have on the position on the color excerpts on a sheet of printing material, in particular the angular position of the at least one cylinder, may be stored in the control so that the vibration-induced deviation from a nominal position of the color excerpt(s), in particular the nominal angular position of the cylinder, is determinable for the current values of operating parameters. An important application of this is to be seen in view of the dependence on whether the press is in the straight printing mode or in the perfecting mode. Storing the relationship may be of particular advantage because it does not require much computing power and is thus of low cost. The relationship results from the cylinder position, some constructional data, and the printed format, and is based on simple geometric observations. The relationship may be stored in the form of a table.

In accordance with a preferred embodiment of the method according to the invention, the actuators and actuating algorithms provided for correcting the position of the printing plates are used for the compensating circumferential register adjustment, in particular the cylinder adjustment, which is necessary in accordance with the result of the calculation, in particular using the same following movement.

It has been found that vibration phenomena in sheet-fed printing presses during normal printing operation can be described with sufficient accuracy through the use of a linear model, for example based on coupled torsion oscillators. There is a plurality of sufficiently accurate methods of calculation for linear models. Provided that the model description is sufficiently accurate, it is therefore advantageous if the model on which the calculation of the current vibration state is based in the method according to the invention, is a linear model.

In situations that go beyond a normal printing operation, there may be non-linear vibration phenomena, so that a linear description is no longer sufficient. In an advantageous further development of the method according to the invention, the model on which the calculation of the current vibration state is based is non-linear. A non-linear model may be based, for example, on torsion oscillators that are coupled with play.

In a preferred embodiment of the method according to the invention, vibrations of a non-integer order are actively compensated for in addition by feeding in compensating torques. The vibrations of a non-integer order may be of a rational order (fractional, but not integer) or an irrational order, i.e. they may be vibrations having a frequency which is a rational or irrational multiple of the operating frequency of the printing press. These vibrations may also be referred to as asynchronous vibrations.

As mentioned above, the vibration-induced dynamic register deviation usually is only one part of a resultant total register deviation. In particular, apart from the dynamic register deviation, there may be a static register deviation, as already indicated above, in particular due to static torques or contortions. In accordance with an advantageous development of the invention, an adjustment necessitated due to static factors may be added to the compensating adjustment of the circumferential register, in particular of the cylinder (to compensate for a vibration-induced dynamic register deviation), which is necessary according to the calculation result.

With the objects of the invention in view, there is also provided a sheet-fed printing press, in particular a sheet-fed offset printing press, comprising a plurality of printing units and a register control with actuators for modifying angular cylinder positions in individual printing units. In accordance with the invention, a register control of the sheet-fed printing press includes a computing unit and/or a memory unit in which a control program is stored that is usable for carrying out a method having features or combinations of features carried out through the use of the actuators as described in the present description.

The sheet-fed printing press may include a plurality of printing units in modular construction and disposed in a horizontal row. The sheet-fed printing press may include four, five, six, eight, ten, or twelve printing units. The printing press may be a perfecting press. The sheet-fed printing press may include a feeder and a delivery. In specific embodiments, the sheet-fed printing press may include one or more finishing units such as punching or diecutting units, varnishing units, foil stamping units, or cutting units. The sheet-fed printing press may include printing units that operate in accordance with different printing processes. In particular, the printing press may include offset printing units.

Other features which are considered as characteristic for the invention are set forth in the appended claims.

Although the invention is illustrated and described herein as embodied in a method of compensating for vibration-induced circumferential register errors in a sheet-fed printing press and a sheet-fed printing press carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF DRAWING

Figure 2:
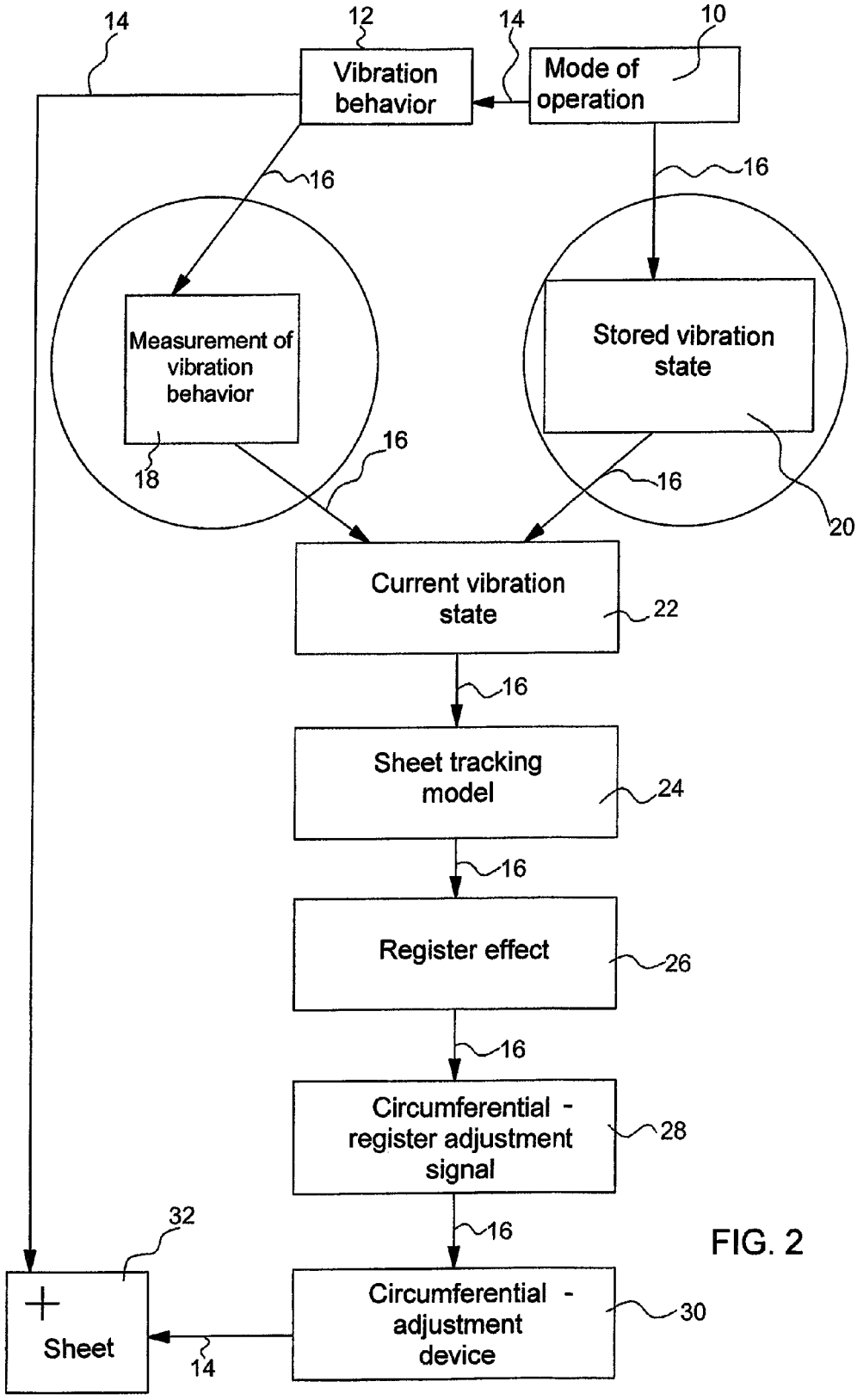

FIG. 1 is a set of graphs representing vibration amplitude LP as a function of angle of rotation $\phi$ of six successive cylinders; and FIG. 2 is a flow chart of an advantageous embodiment of the method of the invention of compensating for vibration-induced circumferential register errors in a sheet-fed printing press.

DETAILED DESCRIPTION OF THE INVENTION

Referring now to the figures of the drawings in detail and first, particularly, to FIG. 1 thereof, there is seen a graphical illustration of vibration amplitude $\Psi$ as a function of angle of rotation $\phi$ of six cylinders following each other. The maximum vibration amplitudes of the six cylinders differ from each other. Apart from the cylinder positions, a model for calculating the effects of vibrations on the register deviation requires an inputting of the angle of rotation of the cylinder relative to the nominal movement, i.e. the movement without vibration, for all cylinders in the sheet-fed printing press, as a function of the machine angle or of time. At specific values of the angle of rotation $\phi$, which are in general reached at specific points in time in different cycles during a printing operation, a transfer occurs from one printing unit to a following printing unit, in particular from one cylinder to a following cylinder, as shown in FIG. 1. At each of these points in time, two cylinders that directly succeed each other have different vibration amplitudes $\Psi$(full and broken lines). The difference between these vibration amplitudes $\Psi$ is the register error that is created upon a respective transfer from one cylinder to a following cylinder or, more precisely, the dynamic proportion of the register deviation in case there are other proportions resulting from other processes, as is shown on the right-hand half for each transfer from one cylinder to a following cylinder.

As an alternative to the situation illustrated in FIG. 1, it is possible to consider cylinders of identical function in the printing units, for example plate cylinders or sheet-guiding cylinders each located in different printing units that succeed each other in a modular way in a sheet-fed printing press. In other words, the cylinders may not follow each other immediately, but may be cylinders of two successive printing units. By way of example, a vibration (for example the first natural vibration of the lowest frequency) may be incited that has a large vibration amplitude at the beginning and at the end of the sheet-fed printing press, whereas the cylinders in the printing units that are closer to the center of the machine have a low maximum vibration amplitude.

FIG. 2 is a flow chart of an advantageous embodiment of the method according to the invention of compensating for vibration-induced circumferential-register errors in a sheet-fed printing press. As is represented by an arrow 14, a mode of operation 10 of the sheet-fed printing press influences a vibration behavior 12 of the sheet-fed printing press. The vibration behavior 12 in turn influences a sheet 32. Optionally, a measurement 18 of the vibration behavior 12 during the operation of the sheet-fed printing press may be taken (signal flow 16), or a stored vibration state 20 may be determined as a function of the mode of operation 10 (signal flow 16). In both cases, the intermediate result is a description of a current vibration state 22. The latter is an input to a sheet tracking model 24, the result of which is a determined register effect 26 of the current vibration state 22. This intermediate result is used to calculate a circumferential-register adjustment signal 28, so that a circumferential-adjustment device 30 may be actuated in a way that corresponds to the current vibration state 22. The circumferential-register adjustment device 30 immediately takes corrective measures (influence 14) on the sheet 32.

The invention claimed is:

1. A method of compensating for vibration-induced circumferential-register errors in a sheet-fed printing press, by compensating for a vibration-induced deviation of an actual angular position of a cylinder from a nominal angular position by a circumferential register adjustment of at least one printing unit, the method comprising the following steps:

determining a current vibration state of the sheet-fed printing press;

calculating an effect of determined vibrations of an integer order on a position of color excerpts on a sheet of printing material separately from an effect of vibrations of a non-integer order;

carrying out a compensating adjustment of the circumferential register as required in accordance with a calculated result; and then adding an adjustment necessitated due to static aspects to the compensating circumferential-register adjustment required in accordance with the result of the calculation.

2. The method of compensating for vibration-induced circumferential-register errors according to claim 1, which further comprises carrying out the adjustment of the circumferential register of at least one printing unit by adjusting a plate cylinder or by adjusting a cylinder located along a path of sheet travel through the printing press.

3. The method of compensating for vibration-induced circumferential-register errors according to claim 1, which further comprises carrying out the adjustment of the circumferential register of at least one printing unit by adjusting a cylinder for which a deviation between the actual angular position and the nominal angular position has been determined.

4. The method of compensating for vibration-induced circumferential-register errors according to claim 1, which further comprises calculating an effect of the determined vibrations of an integer order on the position of the color excerpts on a sheet of printing material in a form of an effect on the nominal angular position of the at least one cylinder.

5. The method of compensating for vibration-induced circumferential-register errors according to claim 1, which further comprises determining a current vibration state by measuring with rotational vibration sensors or torque sensors on the sheet-fed printing press and by determining those vibrations among measured vibrations having a frequency being an integer multiple of an operating frequency of the sheet-fed printing press.

6. The method of compensating for vibration-induced circumferential-register errors according to claim 1, which further comprises selecting a current vibration state as a function of current values of operating parameters from a plurality of vibration state values stored in a memory, parameterized by operating parameters of the sheet-fed printing press and measured in dependence on values of operating parameters, of the sheet-fed printing press.

7. The method of compensating for vibration-induced circumferential-register errors according to claim 1, which further comprises selecting a current vibration state as a function of current values of operating parameters from a plurality of vibration state values stored in a memory, parameterized by operating parameters of the sheet-fed printing press and calculated in dependence on values of operating parameters, of the sheet-fed printing press.

8. The method of compensating for vibration-induced circumferential-register errors according to claim 1, which further comprises calculating a current vibration state as a function of current values of operating parameters from a vibration state having been measured or calculated in dependence on a set of values of operating parameters and stored in a memory.

9. The method of compensating for vibration-induced circumferential-register errors according to claim 1, which further comprises calculating an effect of determined vibrations of an integer order on a position of color excerpts on a sheet of printing material by the sheet-fed printing press with the aid of a concurrent sheet tracking model.

10. The method of compensating for vibration-induced circumferential-register errors according to claim 1, which further comprises storing a relationship for describing an effect of determined vibrations of an integer order on a position of color excerpts on a sheet of printing material, for determining a vibration-induced deviation from a nominal position for current values of operating parameters.

11. The method of compensating for vibration-induced circumferential-register errors according to claim 1, which further comprises carrying out the compensating circumferential-register adjustment necessary in accordance with the result of the calculation, by the actuators and actuating algorithms used for correction of a position of printing plates.

12. The method of compensating for vibration-induced circumferential-register errors according to claim 1, which further comprises basing a calculation of a current vibration state on a linear model.

13. The method of compensating for vibration-induced circumferential-register errors according to claim 1, which further comprises basing a calculation of a current vibration state on a non-linear model.

14. The method of compensating for vibration-induced circumferential-register errors according to claim 1, which further comprises actively compensating for vibrations of a non-integer order by feeding in compensating torques.

15. A sheet-fed printing press, comprising:

a plurality of printing units; and a register control including actuators for changing angular cylinder positions in individual printing units, said register control having at least one of a computing unit or a memory unit storing a control program suitable for carrying out the method according to claim 1 with said actuators.

* * * * *